US005689179A

United States Patent [19]

Walker

[11] Patent Number: 5,689,179

[45] Date of Patent: Nov. 18, 1997

[54] VARIABLE VOLTAGE REGULATOR SYSTEM

[75] Inventor: Richard E. Walker, The Woodlands, Tex.

[73] Assignee: Compaq Computer Corporation, Houston, Tex.

[21] Appl. No.: 628,469

[22] Filed: Apr. 5, 1996

Related U.S. Application Data

[63] Continuation of Ser. No. 590,771, Jan. 24, 1996.

[51] Int. Cl.[6] ..... G05F 1/44

[52] U.S. Cl. ..... 323/283; 323/284

[58] Field of Search ..... 323/282, 283, 323/284, 267

[56] References Cited

U.S. PATENT DOCUMENTS

| | | | |
|---|---|---|---|
| 4,610,142 | 9/1986 | Davis | 62/3 |
| 4,950,972 | 8/1990 | Berg | 322/8 |
| 5,367,601 | 11/1994 | Hannabery | 392/307 |
| 5,397,941 | 3/1995 | Merrill | 307/475 |
| 5,440,520 | 8/1995 | Schutz et al. | 365/226 |
| 5,530,398 | 6/1996 | Shamlou et al. | 327/545 |

*Primary Examiner*—Stuart N. Hecker
*Assistant Examiner*—Y. J. Han
*Attorney, Agent, or Firm*—Jenkens & Gilchrist

[57] ABSTRACT

The present invention relates to a variable voltage regulator that can be easily adjusted via a jumper, or a signal (provided by another circuit) so that the variable voltage regulator can provide at least one of a plurality of discrete voltages to an integrated circuit, such as a microprocessor. This is useful when a replacement microprocessor requires a different operating voltage than the microprocessor it replaced.

9 Claims, 8 Drawing Sheets

VARIABLE VOLTAGE REGULATOR SYSTEM

CROSS REFERENCE TO OTHER APPLICATIONS

This is a continuation of application Ser. No. 08/590,771 filed Jan. 24, 1996.

The following application of common assignee contains related subject matter:

Ser. No. 08/377,151, filed Jan. 24, 1995, entitled CIRCUIT THAT AUTOMATICALLY SWITCHES BETWEEN SUPPLYING A MICROPROCESSOR WITH A FIRST VOLTAGE AND A SECOND VOLTAGE and is hereby incorporated by reference.

BACKGROUND OF THE INVENTION

1. Technical Field of the Invention

The present invention relates to circuitry for providing one of a plurality of predetermined voltages to an electronic device. In particular, the present invention may provide one of a plurality of predetermined voltages to a microprocessor depending on the processor's family, speed of the processor and yield results desired from the processor.

2. Description of Related Art

With the advancements in microprocessor technology and the enormous quantity of transistors incorporated into microprocessors and other integrated circuitry, there has become a need for some integrated circuits to operate at lower voltages than the standard 5.0 volts. Reasons for operation at lower voltages include the need to decrease the wattage, power consumption and heat creation of an integrated circuit. By operating at voltages other than 5.0 volts manufacturing yields of integrated circuits can be maximized. Also, if one manufacturer produces one original integrated circuit and another manufacture produces a pin-for-pin replacement part, but the replacement part operates at a different voltage, then circuitry is needed to allow the replacement part to be used at the different voltage.

In the past, manufacturers of personal computers, which incorporate microprocessors, would have to physically vary or change components in the power supplies or on circuit cards in order to accommodate microprocessors that operated at voltages other than 5.0 volts. Sometimes different power supplies were required for different operating voltages. It is not economical to incorporate parts that may require a different operating voltage than the rest of the parts in the circuit. Manufacturing and design groups within a corporation can not react to changes and upgrades in circuit and/or microprocessor design quickly. Part sourcing and logistical problems of getting the correct power supply assigned to the right microprocessor can cause slowdowns in manufacturing, production, design and shipping of competed products to the consumer market.

Thus, there is a need for a regulated voltage supply circuit that can adjust its output voltage to one of a plurality of predetermined voltages without making substantial physical changes to the circuit. Such a circuit could accommodate various microprocessors that operate at different voltages, but have the same pin-out and would enable a manufacturer to produce a finished product without production and design slowdowns.

SUMMARY OF THE INVENTION

The present invention is an electronic system that includes an integrated circuit and a variable voltage regulator. The integrated circuit may be a microprocessor. The variable voltage regulator should contain at least a voltage regulator circuit and other circuitry that can adjust the output of the voltage regulator so that the circuit, as a whole, can produce at least one of a plurality of predetermined voltages.

The circuitry that adjusts to the output voltage of the voltage regulator circuit comprises at least a voltage divider or a resistor divider circuit. Included with the divider circuit may be jumpers or transistors to effectively add or remove resistors from the divider circuit. There may also be a variable or programmable resistor to aid in adjusting the output voltage of the variable voltage regulator.

The result of the electronic system is a circuit that allows a first integrated circuit to be replaced by a second integrated circuit even though the second integrated circuit operates at a different voltage than the first integrated circuit.

BRIEF DESCRIPTION OF THE DRAWINGS

A more complete understanding of the method and apparatus of the present invention may be had by reference to the following Detailed Description when taken in conjunction with the accompanying Drawings wherein.

DETAILED DESCRIPTION OF PRESENTLY PREFERRED EXEMPLARY EMBODIMENTS

Figure 1:
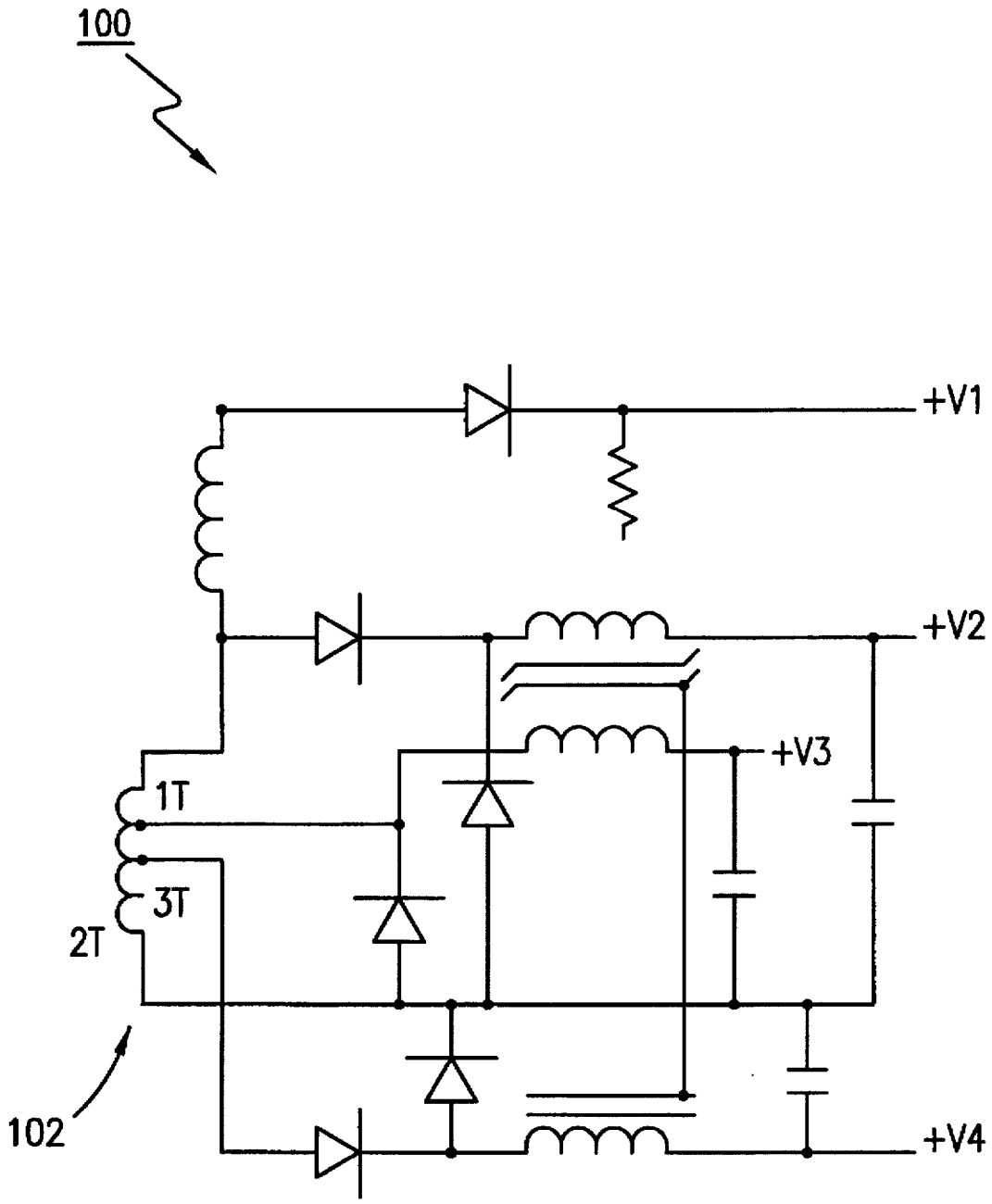
FIG. 1 (PRIOR ART)
FIG. 1 depicts a prior art voltage regulation circuit that provides various voltage outputs.

FIG. 1 depicts a prior art technique voltage regulator circuit 100 for producing four separate voltages V1, V2, V3, and V4. For example V1 may equal 12 volts, V2 may equal 6.6 volts, V3 may equal 5 volts, and V4 may equal 3.3 volts. Basically, a transformer 102 is tapped in a power supply and the voltage drops across some diodes are used to get a variety of output voltages. A drawback of this design is the circuitry must be in the power supply and is hard wired to specific voltages (i.e., this circuit is inflexible). If the regulator circuit 100 is to be used in a personal computer wherein a new integrated circuit is added to the circuitry and the new integrated circuit requires a voltage that is not provided by the power supply, then the power supply will have to be redesigned or replaced with another power supply. This is both costly and inefficient from a manufacturing perspective.

Figure 2:
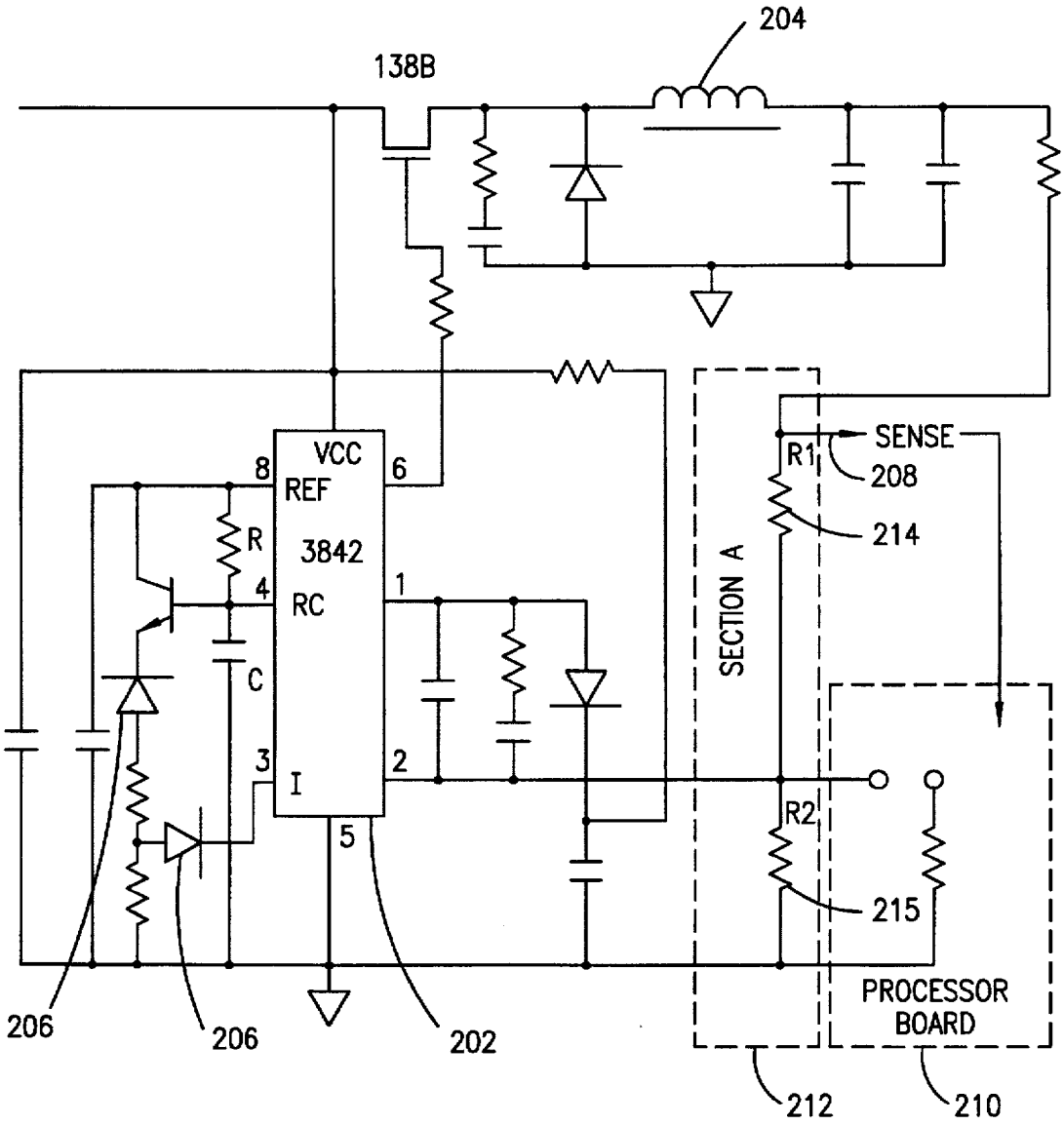
FIG. 2 depicts an exemplary switching regulator circuit.

FIG. 2 depicts an exemplary switching regulator circuit 200. The elements of the regulator circuit 200 comprise an integrated circuit 202 (regulator circuit), an inductor 204, and various diodes 206. This circuit has a relatively high cost to manufacture and the input voltage can never equal the output voltage.

A sense line 208 is connected to a processor board 210 to sense the voltage received at the processor board 210.

Section A 212 comprises at least resistors R1 214 and R2 216. Different values of R1 and R2 (214, 216) could be inserted into the circuit during production of the regulator circuit 200 in order to produce predetermined voltages for the processor board 210. Thus, any output voltage could be established by changing the values of R1 and R2 (214, 216).

One draw back of the regulator circuit 200 is that specific processors (not shown) on processor board 210 may required different voltages. Thus, appropriate resistors R1 and R2 (214, 216) must be installed during manufacturing. The step of making sure the correct resistors are installed slows down the manufacturing process. Thus, there became a need for implementing circuitry in Section A 212 of regulator circuit 200 that does not require part changes on a circuit card during the manufacturing step of the circuitry.

Figure 3:
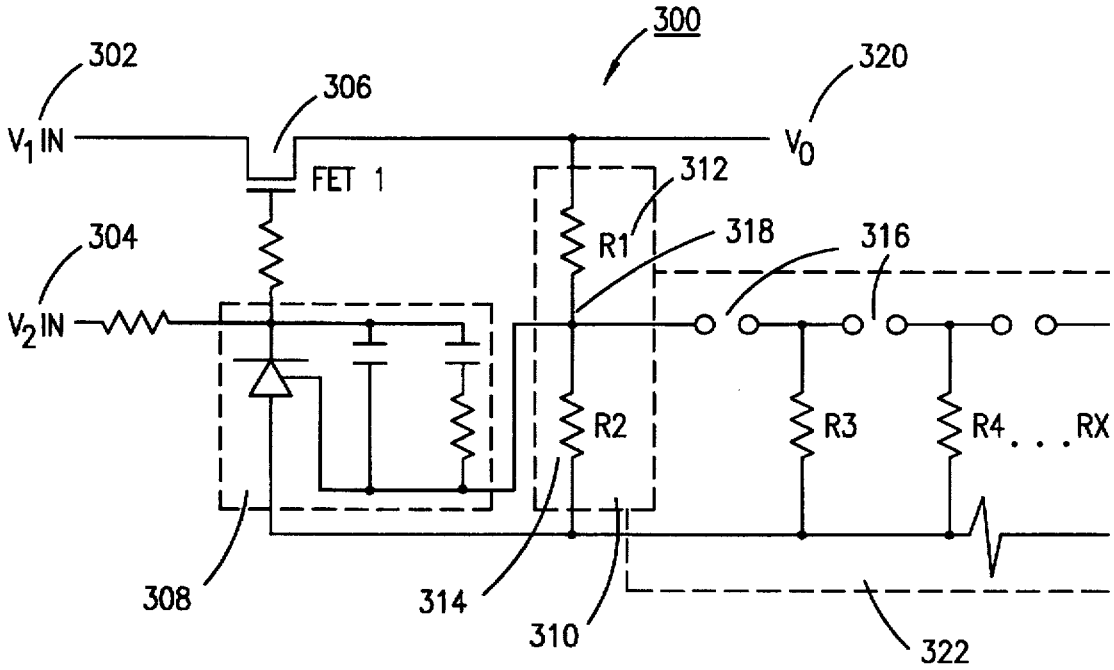
FIG. 3 depicts a first exemplary embodiment of a voltage regulator circuit.

FIG. 3 depicts a first exemplary variable regulator circuit 300. Regulator circuitry 300 preferably comprises a voltage-in-one ("Vin1") 302 which is a generic 5 volt supply; voltage-in-two ("Vin2) 304 which is a generic 12 volt supply; a pass transistor 306 which is preferably an FET or a bipolar transistor; and a reference and comparitor circuit 308 which is preferably a TL431 (regulator circuit). The fore mentioned portions of regulator circuit 300 are used to regulate the voltage found at the critical node 318.

The output voltage Vo 320 is adjusted by the resistor divider circuit 310, which comprises at least R1 and R2 (312, 314). Furthermore, jumper connections 316 can be used to vary the resistance in the voltage divider circuit and thereby vary the Vo voltage 320.

The jumpers can be inserted or removed during production of the circuitry. This is more simple than changing physical resistor values during production. Changing the output of the voltage regulator merely requires either the addition or deletion of one or more jumpers 316 which thereby include or exclude resistors R3, R4 through Rx. The more jumpers that are installed the higher the output voltage Vo 320.

A simple example of how the inventors believe the circuit operates is that when the regulator circuit 308 is set for 3.3 volts at the critical node 318. Then, via the resistor divider circuit 310, R1 and R2 (312, 314), the output voltage Vo 320 can be set to 2.5 volts. As jumpers 316 are added, thereby adding R3, R4, . . . Rx, then more current in required in R1 312 and the output voltage at Vo 320 is raised.

This means for adjusting the output voltage 322 of a voltage regulator circuit uses the addition or deletion of jumpers to a voltage divider circuit 310.

Furthermore, for example, if the exemplary invention is used in a microprocessor based personal computer to control the voltage supplied to the microprocessor, the jumpers could be removed or installed by the consumer if the microprocessor needed replacement and the new microprocessor operated at a different voltage.

The number of different voltages that could be supported by the exemplary embodiment of the present invention is virtually unlimited.

Figure 4:
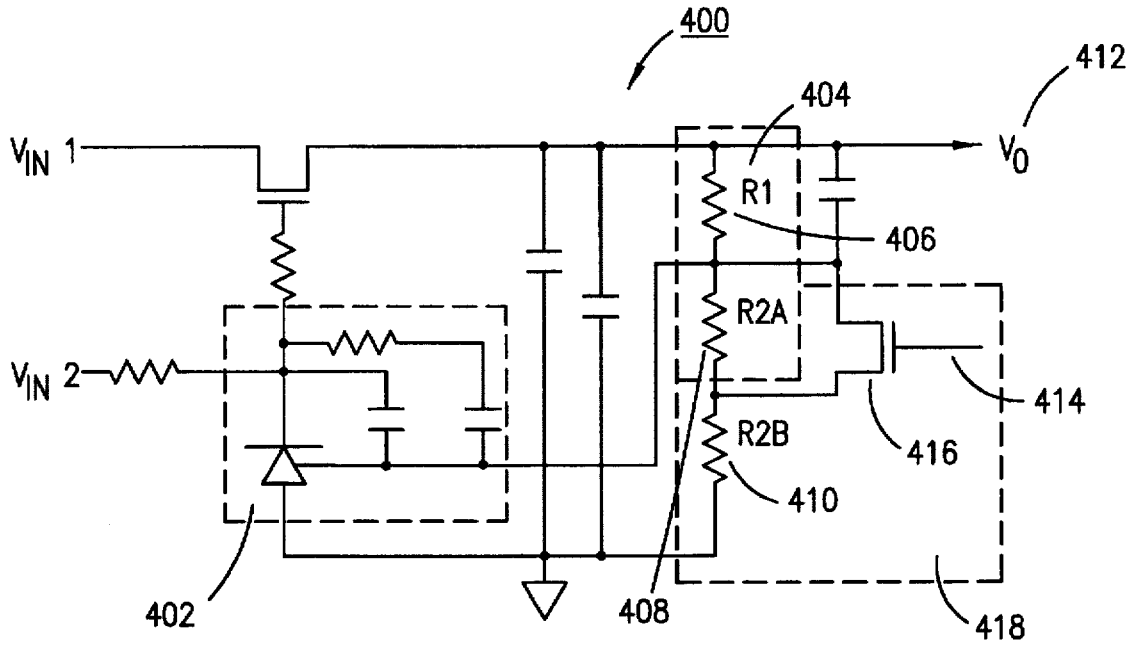
FIG. 4 depicts a second embodiment of a voltage regulator circuit.

FIG. 4 depicts a second embodiment of the present invention. The regulator circuitry 400 is similar to that of regulator circuitry 300, found in FIG. 3. The reference and comparitor circuit 402 could also be an integrated circuit regulation circuit or a variety of nearly equivalent circuits. There is a resistor divider circuit 404 that comprises at least R1 and R2A (406, 408). There also may exist R2B 410 as part of the resistor divider circuit. R1 406 combined with R2A, and R2B (408, 410) will provide a predetermined first output voltage at Vo 412.

If, for example a different voltage is required at Vo, because a different microprocessor is being used, then the processor board (not shown) could send a signal, via signal line 414 to thereby turn on a transistor 416. By turning on the transistor 414, resistor R2B 410 is shorted out, thereby providing a different voltage at Vo 412.

Preferably, the transistor 414 is an FET transistor, but one of ordinary skill in the art may use other transistors or similar elements to perform the same function. The transistor 414 in combination with resistor R2B 410 are essentially another means for adjusting the output voltage of a voltage regulator circuit 418.

It is understood that the circuitry described herein is preferably part of a printed circuit made up of separate components that include, but are not limited to integrated circuits, resistors, transistors, diodes, op-amps, etc. It is further understood that the present invention can completely or almost completely be implemented in silicon as a single or as multiple integrated circuits that could be installed on a printed circuit board.

Figure 5:
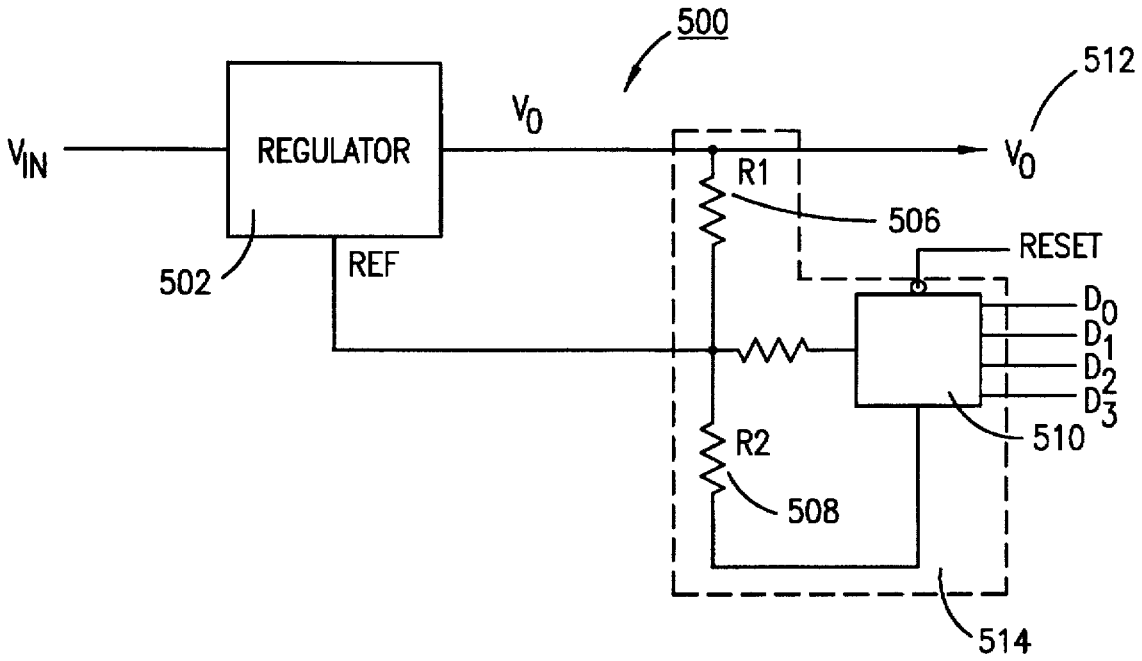
FIG. 5 depicts a third exemplary embodiment of a variable voltage regulation circuit.

FIG. 5 depicts a third exemplary embodiment of the present invention. This exemplary variable voltage regulation circuit 500 comprises a voltage regulator 502 which receives a Vin voltage 502 from a power source (not shown), and a voltage divider circuit 504. The voltage divider circuit 504 comprises R1 506, R2 508 and a variable resistor 510.

The variable resistor 510 shown in FIG. 5 is sometimes known as a programmable or digital resistor. The variable resistor 510 can be a variety of variable resistors. The resistance can be varied by an analog signal, temperature, a mechanical movement, a received light level, a received frequency, etc. The variable resistor 510 can have its resistance varied in steps or by a continual gradual change. The preferred variable resistor 510 used in the present invention is a digitally controlled variable resistor that is varied in discrete steps.

The variable resistor 510 is used in combination with the resistors in the voltage divider circuit 504 to discretely vary the output voltage Vo 512 of the variable voltage regulator circuit 500. The resistor 510 may receive a digital signal from a microprocessor or other circuitry indicating what voltage Vo 512 is required by the microprocessor. The resistor 510 adjusts its resistance accordingly and thereby, in conjunction with R1 and R2 (506, 508) produces the required output voltage Vo 512.

The variable resistor 510 acts as part of a means for varying the output voltage of a voltage regulator 514. More particularly, the variable resistor 510 provides the exemplary embodiment of the present invention the ability to provide variable output voltages for the differing requirements of electronic circuitry which may include the voltage requirements of microprocessors.

Figure 6:
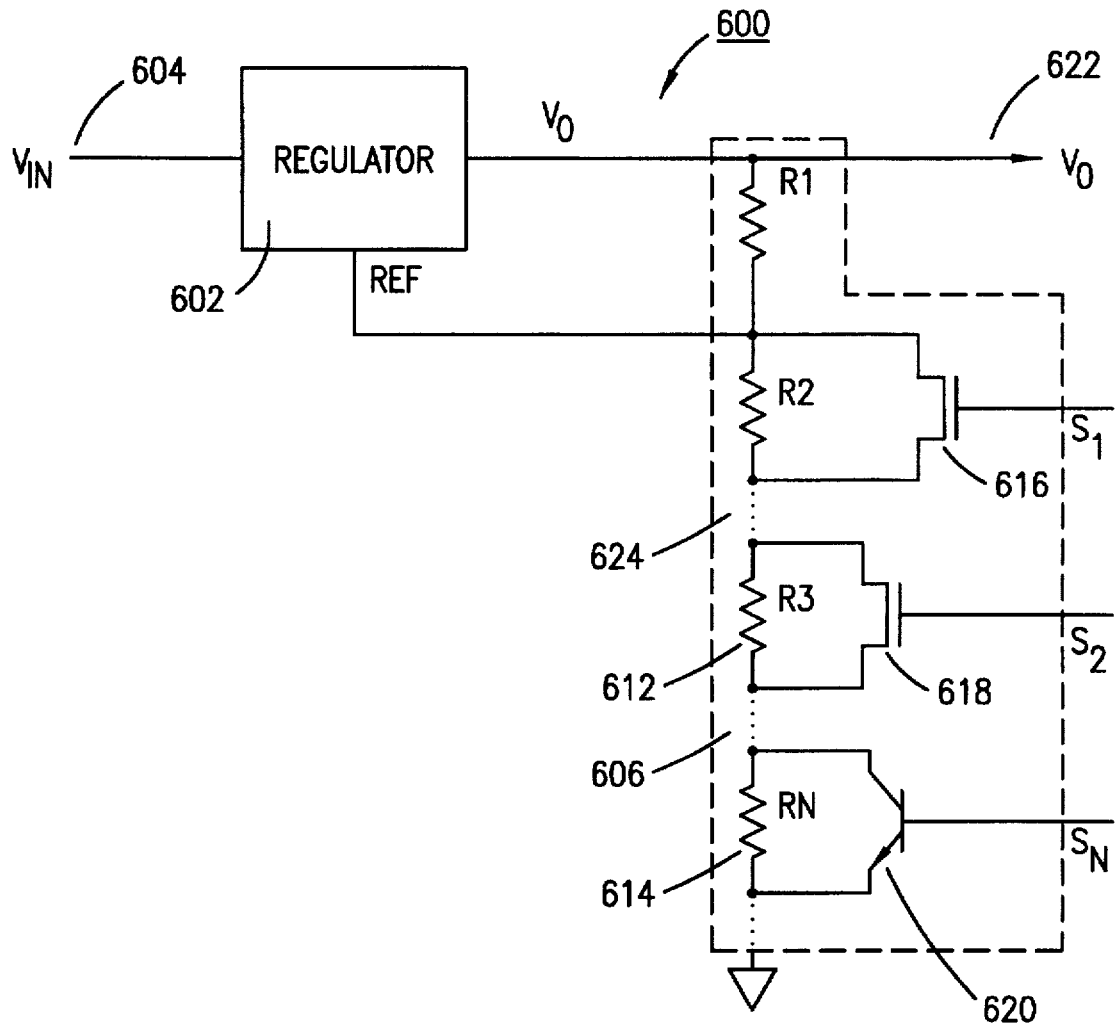
FIG. 6 depicts a fourth exemplary embodiment of a variable voltage regulator.

FIG. 6 depicts a fourth exemplary embodiment of a variable voltage regulator circuit 600. Like the embodiment shown in FIG. 5, there is a voltage regulator circuit which is preferably in the form of an integrated circuit. An input voltage Vin 604 is fed into the voltage regulator 602. There is also a voltage divider circuit 606 in this embodiment. The voltage divider circuit comprises at least R1 and R2 (608, 610). The voltage divider circuit may also include R3 through Rn. Transistors S1, S2, through Sn (661, 618, 620) are connected in parallel to each respective resistor R2 through Rn, as shown in FIG. 6. The Sn transistor 620 or the transistor that is tied to ground can be a bipolar transistor. Transistor S1 616 and any other transistor not tied directly to ground are preferably FET transistors. Of course one of ordinary skill in the art would be able to use other components in place of the preferred components.

Transistors S1 though Sn can be turned on or off via signal lines to thereby discretely change the output voltage at Vo 622. Thus, the combination of the transistors and the divider resistors create a means for varying the output voltage 624.

The signals supplied to transistors S1 through Sn (616, 618, 620) could be provided by a microprocessor or other circuitry so that the correct voltage is provided by the variable voltage regulator 600.

Figure 7:
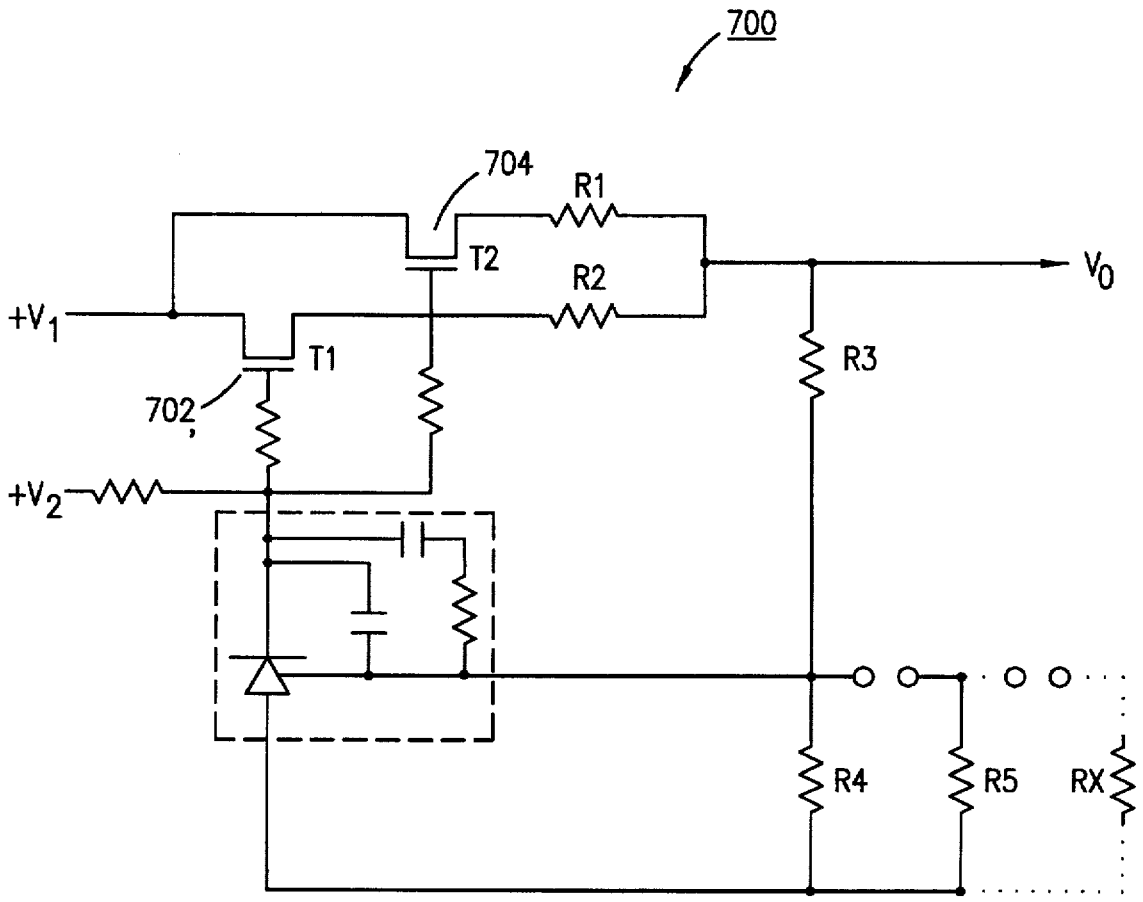
FIG. 7 depicts a fifth embodiment of a variable voltage regulator.

FIG. 7 is a fifth embodiment of the present invention. This embodiment of a variable voltage regulator 700 is similar to the embodiment depicted in FIG. 3, but has two pass transistors T1 and T2 (702 and 704). The pass transistors are preferably FET transistors and are used to increase the current carrying capabilities of the exemplary variable voltage regulator circuit 700.

It is understood that the above described exemplary embodiments are only examples of the variable voltage regulator system claimed later in this document and that the portion of the circuitry that adjusts the resistance in the voltage divider circuits can be matched with a vast variety of fixed regulator circuits to thereby make variable voltage regulators or discretely variable voltage regulator circuits.

Figure 8:
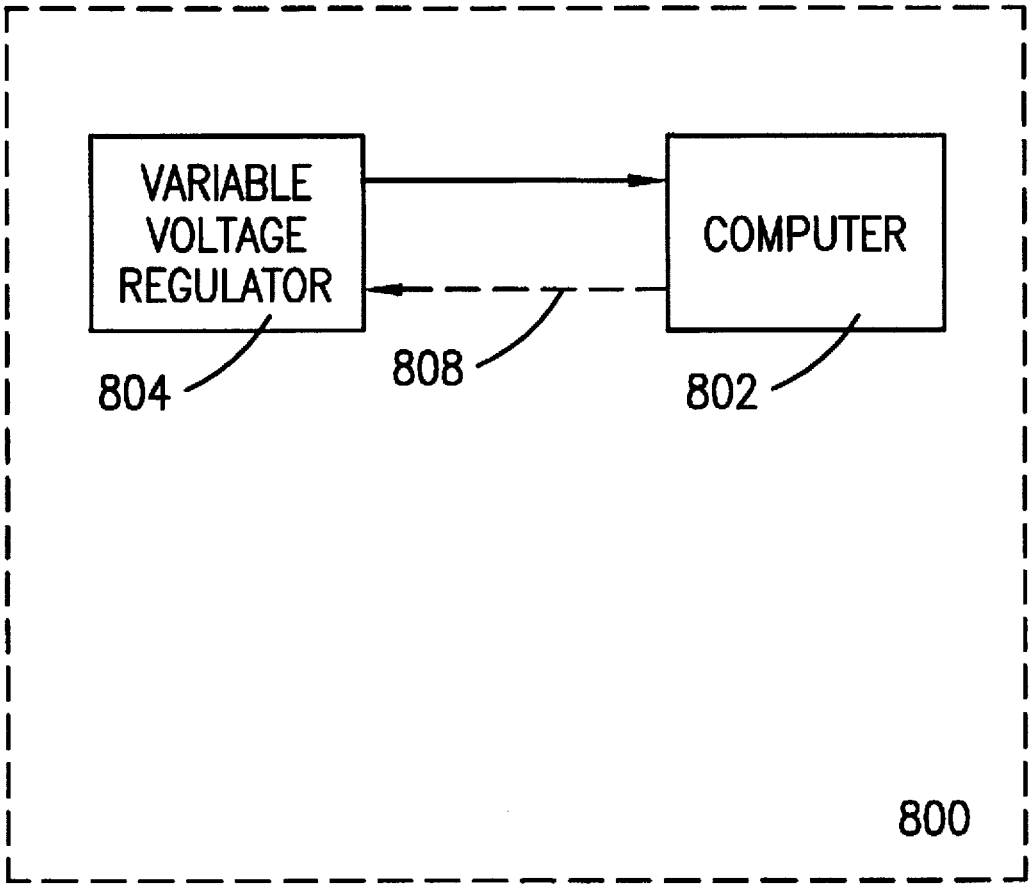
FIG. 8 depicts an embodiment of the preferred invention.

FIG. 8 depicts a variable voltage regulator used in conjunction with a computer 800. The computer 802 is preferably one that incorporates a microprocessor. The variable voltage regulator 804 adjust via a voltage adjustment means so that the microprocessor, or any other circuit within the computer, receives the proper operating voltage. The present invention is very useful were multiple microprocessors may be used in the same circuitry. That is, where a first microprocessor is a pin-for-pin replacement of a second microprocessor, but requires a different operating voltage than the second microprocessor the present invention is very useful.

FIG. 8 actually depicts two embodiments of the present invention. In one embodiment the voltage regulator 804 is set via jumpers or preset resistors to provide at least one voltage to the computer circuitry. In the second embodiment shown the computer provides at least one signal 808 to the voltage regulator indicating what voltage the computer would like to receive from the regulator.

It is understood that the present invention is not limited to providing a voltage to a computer or microprocessor, but instead could be used to provide a specific voltage a wide variety of electronic circuits or components.

Although a preferred embodiment of the method and apparatus of the present invention has been illustrated in the accompanying Drawings and described in the foregoing Detailed Description, it will be understood that the invention is not limited to the embodiment disclosed, but is capable of numerous rearrangements, modifications and substitutions without departing from the spirit of the invention as set forth and defined by the following claims.

What is claimed is:

1. A computer comprising:

one of a first microprocessor and a second microprocessor wherein said first microprocessor requires a different supply voltage than said second microprocessor, and a variable voltage regulator circuit electrically connected to said one of said first microprocessor and said second microprocessor, comprising:

a voltage regulation circuit; and a circuit for varying the output of said voltage regulation circuit, connected to said voltage regulation circuit, said circuit for varying includes a plurality of resistors, connected to said voltage regulation circuit, connected in series such that at least one of said plurality of resistors is shunted by a transistor such that a source of said transistor is connected to a first side of said one of said plurality of resistors and a drain of said transistor is connected to a second side of said one of said plurality of resistors.

2. The computer of claim 1, wherein said variable voltage regulator is capable of providing at least two different voltages to said one of said first microprocessor and said second microprocessor.

3. A variable voltage regulation circuit for use in computer circuitry comprising:

a voltage regulator circuit connected to an input voltage;

a resistor divider circuit connected to a voltage output of said voltage regulator circuit; and circuitry for varying said voltage output of said voltage regulation circuit, said voltage regulation circuit providing one of a plurality of predetermined voltages to a circuit, said circuitry for varying said voltage output including a transistor connected to a resistor in said resistor divider circuit such that a source of said transistor is connected to a first side of said resistor and a drain of said transistor is connected to a second side of said resistor.

4. The variable voltage regulation circuit of claim 3, wherein a signal applied to a gate of said transistor will vary said voltage output.

5. A computer system comprising;

a processor board, said processor board comprising one of a first microprocessor and a second microprocessor installed on said processor board, said first microprocessor requires a first supply voltage and said second microprocessor requires a second supply voltage; and a variable supply voltage circuit having an output electrically connected to said one of said first and said second microprocessors, said voltage supply circuit comprising:

an input portion for receiving at least one supply voltage requirement signal; and a voltage division circuit adapted to receive said at least one voltage requirement signal and capable of adjusting said voltage division circuit in accordance with said voltage requirement signal so that at least one of said first supply voltage and said second supply voltage is provided at said output.

6. The computer system of claim 5, wherein said voltage division circuit includes an FET transistor having a gate connected to said at least one supply voltage requirement signal.

7. The computer system of claim 5, wherein said voltage division circuit includes a digitally controlled variable resistor having at least one digital control input for receiving said at least one supply voltage requirement signal.

8. A computer including a circuit for changing a supply voltage supplied to an interchangeable integrated circuit comprising:

a variable voltage regulation circuit having an input for receiving a main supply voltage and an output for providing a regulated voltage;

a voltage division circuit, connected to said output of said variable voltage regulation circuit, comprising at least one of:

a digitally programmable variable resistor, connected to said output of said variable regulation circuit, adapted to receive a signal and change resistance in order to vary an output voltage of said variable voltage regulation circuit; and a plurality of resistors connected in series to said output of said variable voltage regulation circuit, at least one of said plurality of resistors being shunted by a source and a drain of a transistor, a gate of said transistor being adapted to receive a voltage selection signal.

9. The computer of claim 8, wherein said interchangeable integrated circuit is a microprocessor.

* * * * *